US008075343B2

(12) United States Patent
Fu et al.

(10) Patent No.: US 8,075,343 B2
(45) Date of Patent: Dec. 13, 2011

(54) STRADDLE CARD EDGE CONNECTOR

(75) Inventors: Xiao-Zhi Fu, Kunshan (CN); Zhuang-Xing Li, Kunshan (CN); Ze-Lin Yao, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/862,957

(22) Filed: Aug. 25, 2010

(65) Prior Publication Data

US 2011/0136388 A1 Jun. 9, 2011

(30) Foreign Application Priority Data

Dec. 3, 2009 (CN) ..... 2009 2 0316454

(51) Int. Cl.
*H01R 24/00* (2011.01)

(52) U.S. Cl. ..... 439/637; 439/328; 439/638

(58) Field of Classification Search ..... 439/637, 439/631, 638, 654, 632, 327, 328
See application file for complete search history.

(56) References Cited

U.S. PATENT DOCUMENTS 3,365,696 A * 1/1968 Wagner ..... 439/631
3,482,201 A * 12/1969 Schneck ..... 439/497
4,660,920 A * 4/1987 Shibano ..... 439/631
5,160,275 A * 11/1992 Nakamura et al. ..... 439/328
5,295,852 A * 3/1994 Renn et al. ..... 439/328
5,531,615 A * 7/1996 Irlbeck et al. ..... 439/631
6,709,296 B2 3/2004 Shiroyama et al.
7,416,452 B1 * 8/2008 Sabo ..... 439/631
7,731,518 B2 * 6/2010 Miyazoe ..... 439/328
2009/0104818 A1 * 4/2009 Wu et al. ..... 439/638
2010/0015835 A1 * 1/2010 Mizumura ..... 439/328
2011/0151701 A1 * 6/2011 Ngo ..... 439/327

* cited by examiner

*Primary Examiner* — Hae Moon Hyeon
(74) *Attorney, Agent, or Firm* — Wei Te Chung; Andrew C. Cheng; Ming Chieh Chang

(57) ABSTRACT

A card edge connector includes an elongated housing and a number of contacts retained in the housing. Each contact has a retaining portion retained in the housing, a contact portion forwardly extending from a front end of the retaining portion and a connecting portion backwardly extending from a rear end of the retaining portion. The contacts are arranged in two rows and formed with a first receiving space between two rows of contact portions to receive a module and a second receiving space between two rows of connecting portions to receive a mother board. The first receiving space defines a first center line along an insertion direction of the module. The second receiving space defines a second center line which is parallel to the first center line and offset to the first center line along an up to down direction perpendicular to the insertion direction.

20 Claims, 6 Drawing Sheets

STRADDLE CARD EDGE CONNECTOR

BACKGROUND OF THE INVENTION

1. Field of the Invention

The present invention relates to card edge connectors, more particularly to card edge connectors straddling on a mother board.

2. Description of Related Art

Card edge connectors are employed widely in computers to receive a memory card, graphic card, network interface card or a module with a plurality of electronic components thereon et al. The card edge connectors usually have an elongated housing, a plurality of contacts retained in the housing. The contacts are arranged in two rows to sandwich a module at one end thereof and straddle on a mother board at another end thereof. Each contact has a retaining portion retained in the housing, a first contact portion upwardly and inwardly extending from a front end of the retaining portion to connect with the module, and a second contact portion downwardly and inwardly extending out of the housing to connect with the mother board. Therefore, the contacts of two rows are formed with a first receiving space between the first contact portions to retain the module, and a second receiving space between the second contact portions to retain the mother board. The first receiving space has a centre line which is aligned to that of the second receiving space along an up to down direction.

A server is usually has a module with a power supply device at one side thereof to transmit power signals. With a miniature development of electronic industry, the server becomes much smaller and has limited space to hold the power supply device on one side of the module. However, because the first and second receiving spaces have a common centre line, which make the module and the mother board are located on a common plane; therefore, an outer surface of the power supply device on one side of the module and an outer surface of the mother board defines a large distance which can not be reduced, while another side of the module and mother board is leisure, which result in one side of the mother board is too thicker to be retained to the server, while another side is wasted.

Hence, an improved card edge connector is desired to overcome the above problems.

BRIEF SUMMARY OF THE INVENTION

According to one aspect of the present invention, a card edge connector, comprises: an elongated housing having a top wall and a bottom wall opposed to each other, the top wall and bottom wall each defining a plurality of passageways; and a plurality of contacts comprising a plurality of first contacts and a plurality of second contacts being arranged in two rows and respectively retained in the top wall and bottom wall, each first contact having a first retaining portion retained in the passageways of the top wall, a first contact portion forwardly extending from a front end of the first retaining portion and a first connecting portion backwardly extending from a rear end of the first retaining portion, each second contact having a second retaining portion retained in the passageways of the bottom wall, a second contact portion forwardly extending from a front end of the second retaining portion and a second connecting portion extending from a rear end of the second retaining portion, the first contact portions and the second contact portions defining a first receiving space therebetween to receive a module, the first connecting portions and the second connecting portion defining a second receiving space therebetween to receive a mother board; wherein the first receiving space defines a first centre line along an insertion direction of the module, and the second receiving space defines a second centre line which is parallel to the first centre line and offset to the first centre line along an up to down direction perpendicular to the insertion direction.

According to another aspect of the present invention, a card edge connector, comprises: an elongated housing having a top wall and a bottom wall opposed to the top wall, the top wall having a first mounting surface at a rear end thereof, and the bottom wall having a second mounting surface at a rear end thereof; and a plurality of contacts retained in the housing, the contacts comprising a plurality of first contacts arranged in an upper row and a plurality of second contacts arranged in a lower row parallel to the upper row, each first contact having a first retaining portion retained in the top wall and horizontally extending to the first mounting surface, a first contact portion forwardly extending from a front end of the first retaining portion and a first connecting portion extending from a rear end of the first retaining portion, each second contact having a second retaining portion retained in the bottom wall and horizontally extending to the second mounting surface, a second contact portion forwardly extending from a front end of the second retaining portion and a second connecting portion extending from a rear end of the second retaining portion, the first contact portions and the second contact portions defining a first receiving space therebetween to receive a module, the first connecting portions and the second connecting portion defining a second receiving space therebetween to receive a mother board; wherein the bottom wall is longer than the top wall along an insertion direction of the module to make the second mounting surface is located at a rear side of the first mounting surface.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
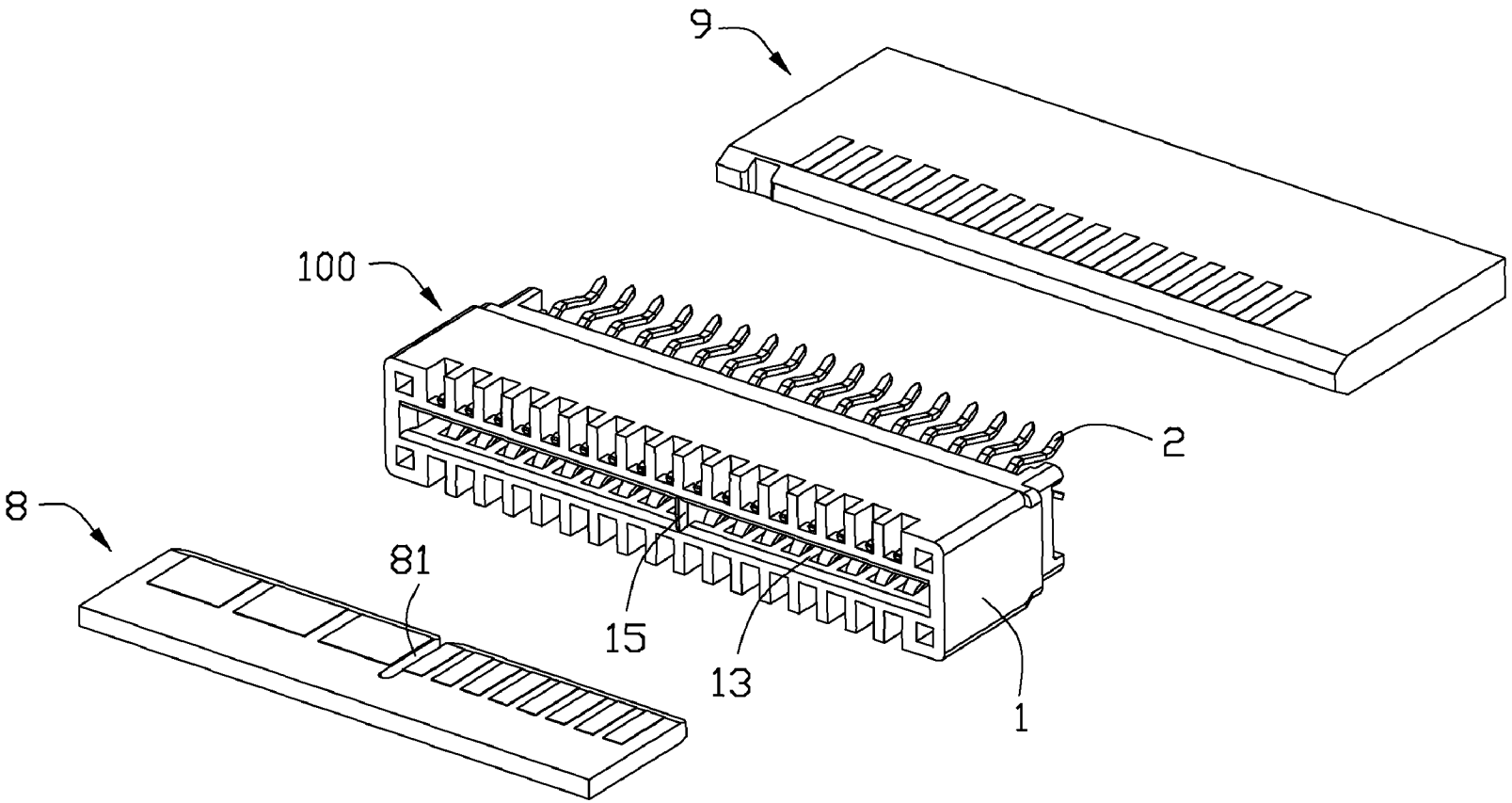
FIG. 1 is a perspective view of a card edge connector, a module and a mother board according to the present invention showing that the module and the mother board are not inserted to the card edge connector.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
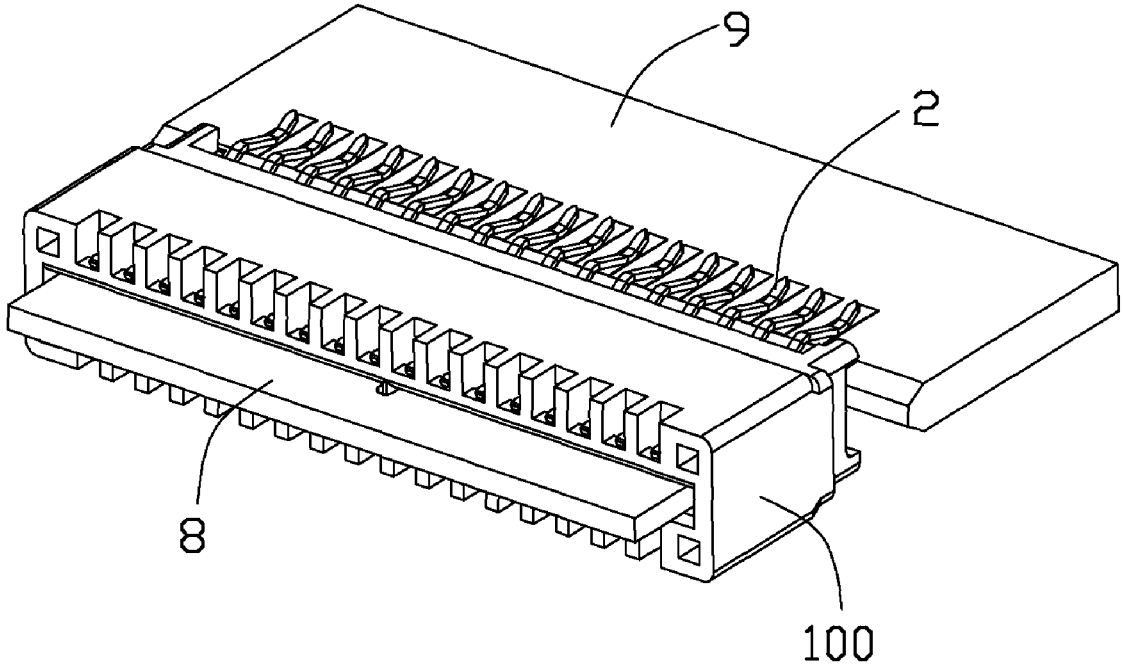
FIG. 2 is a perspective view of the card edge connector with the module and mother board being inserted therein.
Figure 3:
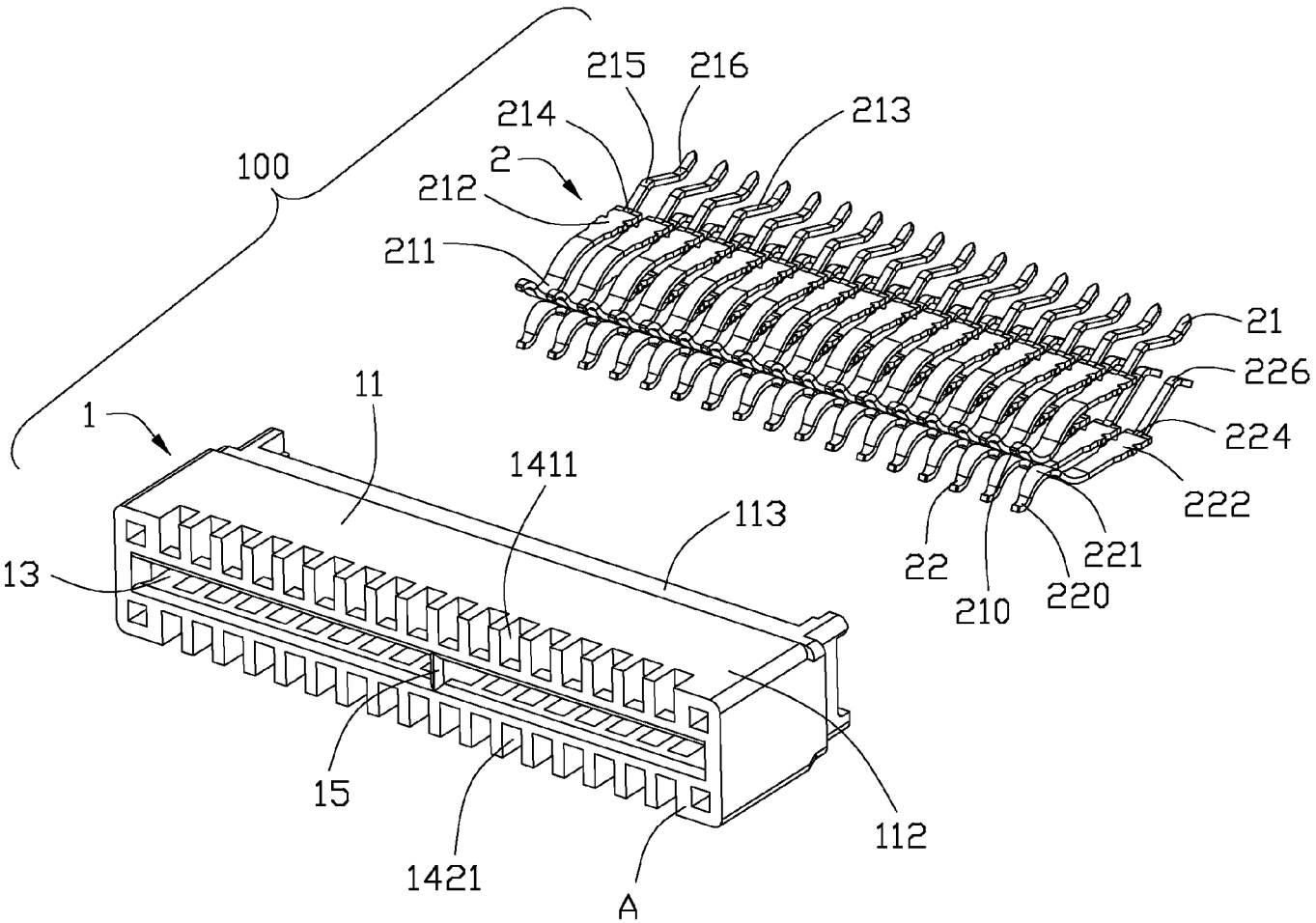
FIG. 3 is an exploded view of the card edge connector shown in FIG. 1.
Figure 4:
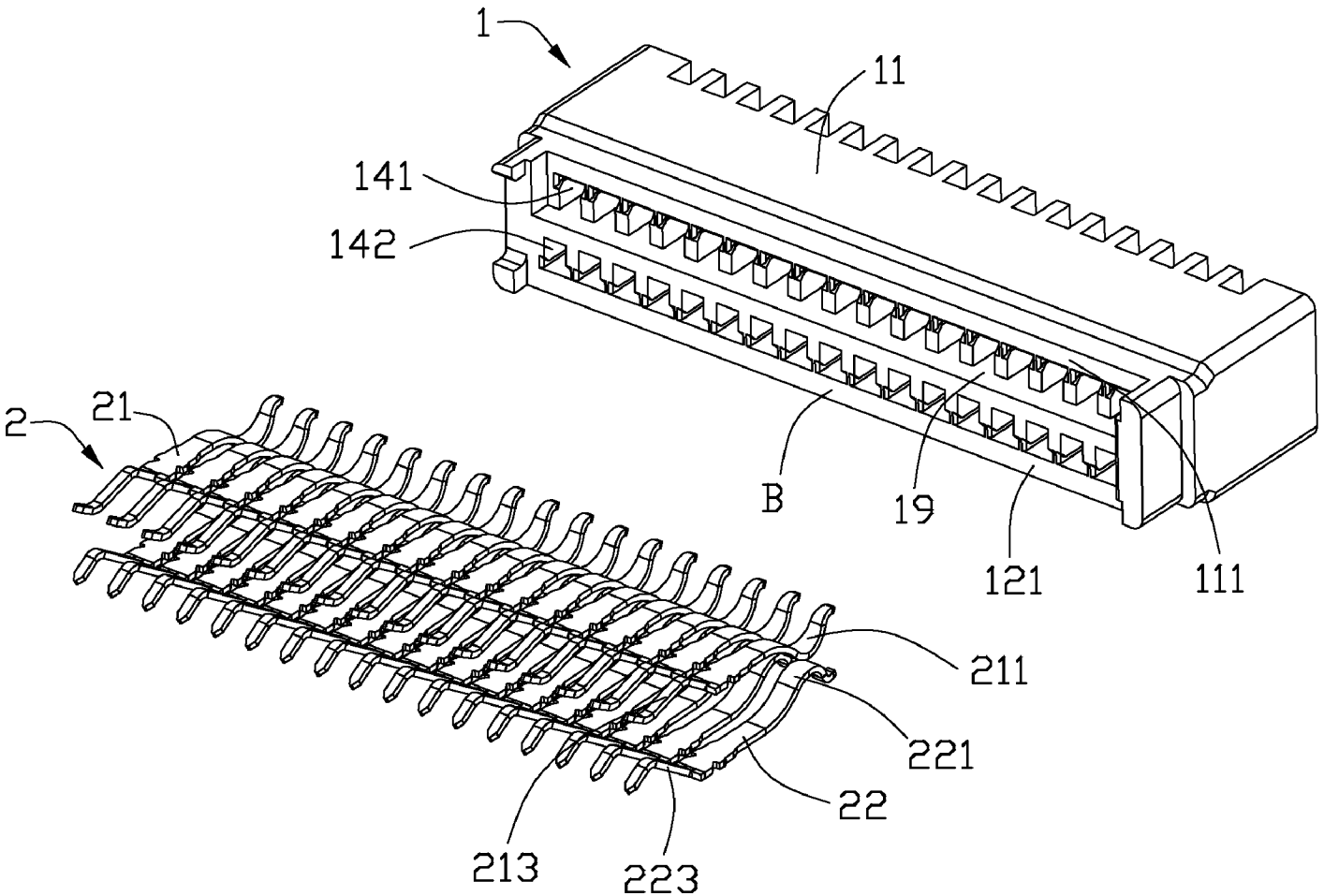
FIG. 4 is a view similar to FIG. 3, while taken from a different aspect.
Figure 5:
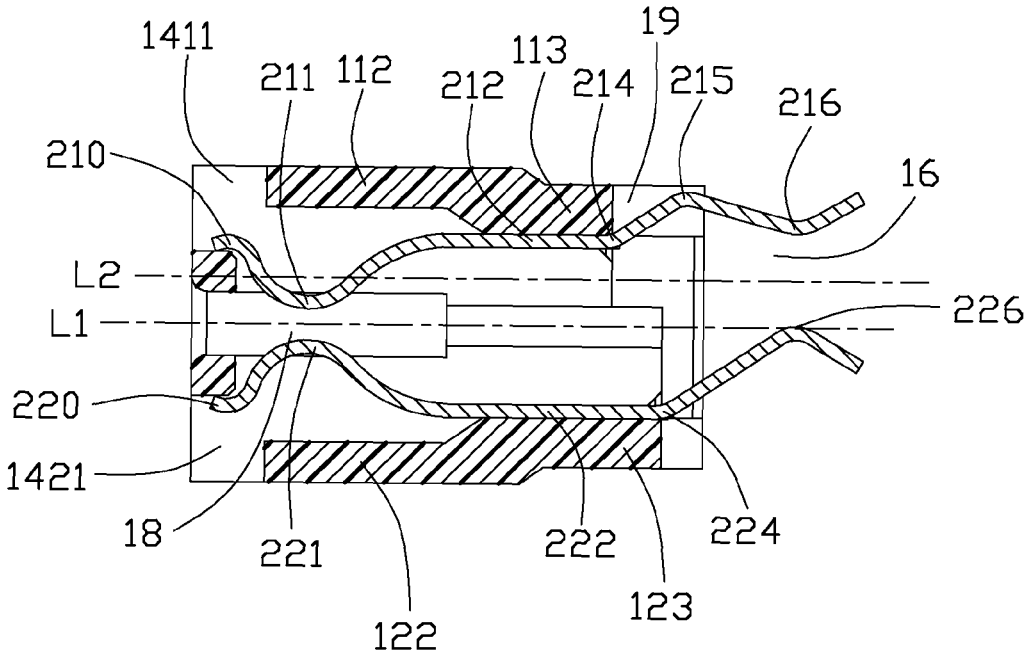
FIG. 5 is a cross-sectional view of the card edge connector shown in the FIG. 1.
Figure 6:
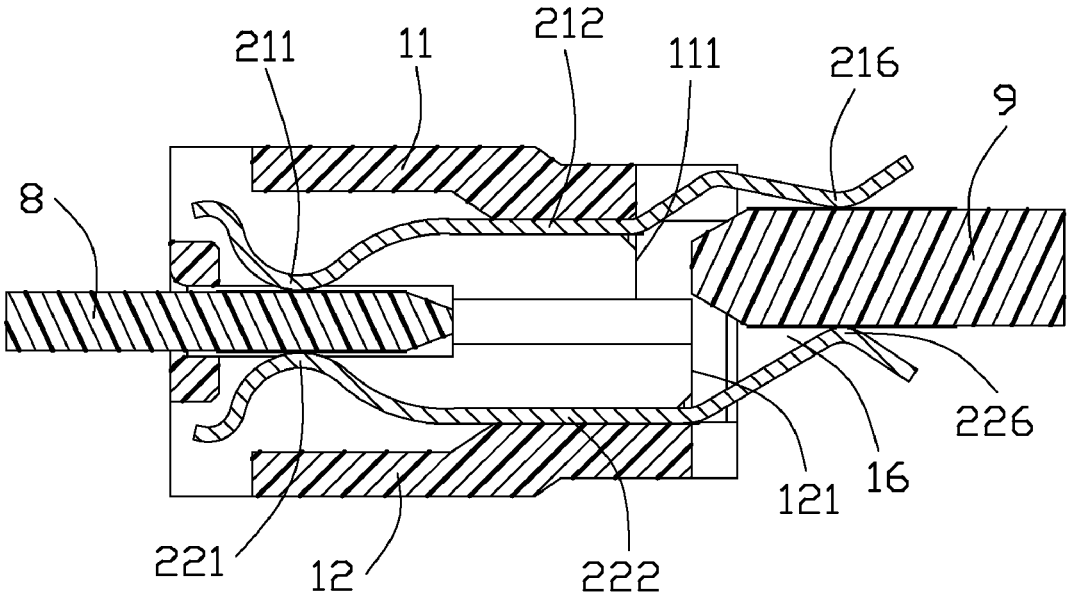
FIG. 6 is a cross-sectional view of the card edge connector with the module and mother board being inserted therein.

Referring to FIGS. 1-6, a card edge connector 100 for mating with a module 8 and straddling on a mother board 9 according to the present invention is disclosed. The card edge connector 100 comprises an elongated housing 1 and a plurality of contacts 2 retained in the housing 1.

The housing 1 has a top wall 11 and a bottom wall 12 opposed to the top wall 11, and a centre slot 13 opening forwardly between the top wall 11 and bottom wall 12 for receiving the module 8. The housing 1 further has a flat front face A at a front side thereof and a step rear face B at a rear side thereof. The step rear face has a first mounting surface 111 at a rear end of the top wall 11 and a second mounting surface 121 at a rear end of the bottom wall 12. The second mounting surface 121 is located at a rear side of the first mounting surface 111, therefore, the bottom wall 12 has a length which is longer than that of the top wall 11 along an insertion direction of the module 8, and the housing 1 is formed with a cutout 19 between the first mounting surface 111 and the second mounting surface 121 along a front to back direction. The cutout 19 opens backwardly and upwardly at a rear side of the top wall 11. The housing 1 further has a partition block 15 protruding into the centre slot 13 to divide the centre slot 13 to two parts with different lengths for preventing the module 8 from being mis-mated. The module 8 has a notch 81 corresponding to the partition block 15.

The top wall 11 has a first front section 112 and a first rear section 113 backwardly and downwardly extending from a rear end of the first front section 112. The bottom wall 12 has a second front section 122 and a second rear section 123 backwardly and upwardly extending from a rear end of the second front section 122. The first front section 112 is spaced apart from the second front section 122 along an up to down direction perpendicular to the insertion direction, and has a length same to that of the second front section 122 along the insertion direction. The centre slot 13 is located between the first front section 112 and the second front section 122 along the up to down direction. The first rear section 113 connects with the second rear section 123 along the up to down direction, and has a length shorter than that of the second rear section 123, thereby the second rear section 123 backwardly protrudes beyond of the first rear section 113. The first rear section 113 defines a plurality of first retaining slots 141 extending through the housing 1 along the insertion direction to retain the contacts 2. The second rear section 123 defines a plurality of second retaining slots 142 extending through the housing 1 along the insertion direction to retain the contacts 2. The contacts 2 are mainly retained at the position of the first and second rear sections 113, 123 and extend to the first and second front sections 112,122. The first and second retaining slots 141, 142 communicate with the centre slot 13 along the up to down direction.

Besides, the top wall 11 defines a plurality of first openings 1411 opening forwardly and upwardly at a front end thereof. The first openings 1411 communicate with the first retaining slots 141 along the up to down direction and the insertion direction. The bottom wall 12 defines a plurality of second openings 1421 opening forwardly and downwardly at a front end thereof. The second openings 1421 communicate with the second retaining slots 142 along the up to down direction and the insertion direction.

The contacts 2 are retained in the housing 1, and comprise a plurality of first contacts 21 arranged in an upper row and a plurality of second contacts 22 arranged in a lower row. Each first contact 21 has a first retaining portion 212 retained in the first retaining slots 141 of the first rear section 113, a first contact portion 211 forwardly extending from a front end of the first retaining portion 212, a first connecting portion 213 backwardly extending out of the first mounting surface 111 from a rear end of the first retaining portion 212, and a first resisting portion 210 forwardly extending from a front end of the first contact portion 211. The first connecting portion 213 has a first bending portion 214 directly bending upwardly from the rear end of the first retaining portion 212, a second bending portion 215 downwardly bending from a free end of the first bending portion 214 and a first mating portion 216 at a rear end of the second bending portion 215 to connect with one side of the mother board 9. The first resisting portions 210 resist inner walls of the first retaining slots 141 at a front side of the first front section 112, and forwardly and upwardly open to exterior via the first openings 1411 for dissipating heat when the first contacts 21 are used to transmit power.

The first contact portions 211 are arranged in a row and downwardly protrude into the centre slot 13. The first mating portions 216 are arranged in another row which is upwardly offset to the first contact portions 211 along the up to down direction. The first retaining portions 212 horizontally extend along the insertion direction and extend to the first mounting surface 111. Therefore, the first contact portions 211 are located at a lower side of the first retaining portions 212 along the up to down direction, while the first mating portions 216 are located at an upper side of the first retaining portions 212 along the up to down direction. Besides, because the first bending portions 214 directly extend upwardly from the rear end of the first retaining portion 212, the first bending portions 214 are located at a front side of the second mounting surface 121 and received in the cutout 19.

Each second contact 22 has a second retaining portion 222 retained in the second retaining slots 142 of the second rear section 123, a second contact portion 221 forwardly extending from a front end of the second retaining portion 222, a second connecting portion 223 backwardly extending out of the second mounting surface 121 from a rear end of the second retaining portion 222, and a second resisting portion 220 forwardly extending from the second contact portion 221. The second connecting portion 223 has a third bending portion 224 directly bending upwardly from the rear end of the second retaining portion 222 and a second mating portion 226 at a free end of the third bending portion 224 to connect with another side of the mother board 9. The second retaining portion 222 defines a length which is longer than the first retaining portion 212 along the insertion direction. The first connecting portions 213 are longer than the second connecting portions 223 along the insertion direction to make the first contact 21 has a length same as the second contact 22 along the insertion direction. The second resisting portions 220 resist inner walls of the second retaining slots 142 at a front side of the second front section 122, and forwardly and downwardly open to exterior via the second openings 1421 for dissipating heat when the second contacts 22 are used to transmit power.

The second contact portions 221 are arranged in a row and upwardly protrude into the centre slot 13 toward the first contact portions 211. The second mating portions 226 are arranged in another row which is upwardly offset to the second contact portions 221 along the up to down direction, therefore, the second mating portions 226 are located at an upper side of the second contact portions 221 along the up to down direction. Besides, the second retaining portions 222 horizontally extend along the insertion direction to the second mounting surface 121, thereby the second contact portions 221 and the second mating portions 226 are located at an upper side of the second retaining portions 222 along the up to down direction. The first and second front sections 112, 122 are located at outsides of the first and second rear sections 113, 123 to make the passageways 141, 142 in the first and second front sections 112, 122 be larger than that in the first and second rear sections 113, 123, thereby the first and second contact portions 211, 221 have a large deformation space.

As described above, the first contact portions 211 and the second contact portions 221 extend toward each other and align to each other along the up to down direction to form a first receiving space 18 therebetween for receiving the module 8. The first receiving space 18 overlaps with the centre slot 13, and actually, the first receiving space 18 is the centre slot 13 in the present invention. The first bending portion 214, second bending portion 215 and third bending portion 224 are staggered with each other along the insertion direction, wherein the third bending portion 224 is located at a rear side of the first bending portion 214, and the second bending portion 215 is located at a rear side of the third bending portion 224. The first mating portions 216 and the second mating portions 226 are aligned to each other along the up to down direction and extend toward each other to form a second receiving space 16 therebetween at a rear side of the housing 1 for receiving the mother board 9. The mother board 9 is thicker than the module 8. The second receiving space 16 is wider than the first receiving space 18 along the up to down direction. The second receiving space 16 is located at a rear side of the cutout 19 and communicates with the cutout 19 along the insertion direction.

The first contact portions 211 and the second receiving space 16 overlap with each other along the insertion direction, while the second contact portions 211 and the second receiving space 16 do not overlap with each other along the insertion direction; besides, the second mating portions 226 overlap with the first receiving space 18 along the insertion direction, while the first mating portions 216 and the first receiving space 18 do not overlap with each other along the insertion direction. In addition, the first mating portion 216 is located at an upper side of the first bending portion 214 along the up to down direction, thereby the first bending portions 214 overlap with the second receiving space 16 along the insertion direction. A rear end of the first connecting portions 213 do not upwardly extend out of the housing 1 before the mother board 9 is inserted into the second receiving space 16 along the up to down direction, while extend out of the housing 1 after the mother board 9 is inserted into the second receiving space 16.

The first receiving space 18 defines a first central line L1 along the insertion direction. The second receiving space 16 defines a second central line L2 along the insertion direction. The first central line L1 is parallel to the second central line L2 and downwardly offset to the second central line L2, therefore, a power supply device or other electronic components (not shown) can be set on an upper side of the module 8, and a distance between a top surface of the power supply device and a top surface of the mother board 9 is decreased to be much smaller than a thickness of the power supply device, then a distance between the top surface of the mother board 9 and a shell of a server (not shown) which used the card edge connector 100 of the present invention is decreased, which further decreases a thickness of the server and adapts to a miniature development of the electronic industry. Besides, the second mounting surface 121 is located at a rear side of the first bending portion 214 to resist a front end of the mother board 9, then the mother board 9 can be prevented from overly being inserted forwardly into the cutout 19 to resist the first bending portion 214.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector, comprising:

an elongated housing having a top wall and a bottom wall opposed to each other, the top wall and bottom wall each defining a plurality of passageways; and a plurality of contacts comprising a plurality of first contacts and a plurality of second contacts being arranged in two rows and respectively retained in the top wall and bottom wall, each first contact having a first retaining portion retained in the passageways of the top wall, a first contact portion forwardly extending from a front end of the first retaining portion and a first connecting portion backwardly extending from a rear end of the first retaining portion, each second contact having a second retaining portion retained in the passageways of the bottom wall, a second contact portion forwardly extending from a front end of the second retaining portion and a second connecting portion extending from a rear end of the second retaining portion, the first contact portions and the second contact portions defining a first receiving space therebetween to receive a module, the first connecting portions and the second connecting portion defining a second receiving space therebetween to receive a mother board;

wherein the first receiving space defines a first centre line along an insertion direction of the module, and the second receiving space defines a second centre line which is parallel to the first centre line and offset to the first centre line along an up to down direction perpendicular to the insertion direction.

2. The card edge connector as claimed in claim 1, wherein the housing defines a centre slot between the top wall and the bottom wall, the first contact portions and second contact portions protrude into the centre slot toward each other, the first connecting portions and the second connecting portions backwardly extend out of the housing along the insertion direction.

3. The card edge connector as claimed in claim 2, wherein the first connecting portion has a first bending portion directly bending upwardly from the first retaining portion, a second bending portion downwardly bending from a rear end of the first bending portion and a first mating portion at a free end of the second bending portion to connect with one side of the mother board.

4. The card edge connector as claimed in claim 3, wherein the second connecting portion has a third bending portion upwardly bending from the second retaining portion and a second mating portion at a free end of the third bending portion to connect with another side of the mother board.

5. The card edge connector as claimed in claim 4, wherein the first bending portion, second bending portion and third bending portion are staggered with each other along the insertion direction, while the first mating portion and the second mating portion are aligned to each other along the up to down direction.

6. The card edge connector as claimed in claim 4, wherein the first retaining portions horizontally extend along the insertion direction, the first contact portions are located at a lower sides of the first retaining portions along the up to down direction, and the first mating portions are located at an upper side of the first retaining portions along the up to down direction.

7. The card edge connector as claimed in claim 6, wherein the second retaining portions horizontally extend along the insertion direction, and the second contact portions and the second mating portions are located at an upper side of the second retaining portions along the up to down direction.

8. The card edge connector as claimed in claim 7, wherein the second mating portions are located at an upper side of the second contact portions along the up to down direction, and the second receiving space is wider than the first receiving space along the up to down direction.

9. The card edge connector as claimed in claim 7, wherein the first connecting portions and second connecting portions do not extend out of the housing along the up to down direction before the mother board is inserted into the second receiving space, while the first connecting portions extend out of the housing after the mother board is inserted into the second receiving space.

10. The card edge connector as claimed in claim 1, wherein the first retaining portion defines a length which is shorter than that of the second retaining portion along the insertion direction, and the first connecting portion defines a length which is longer than that of the second connecting portion along the insertion direction to make the first contact has a length same as the second contact has along the insertion direction, and the top wall has a first mounting surface aligning to the rear end of the first retaining portion along the up to down direction, and the bottom wall has a second mounting surface aligning to the rear end of the second retaining portion along the up to down direction, and the second mounting surface is located at a rear side of the first mounting surface for limiting the mother board moving forwardly.

11. A card edge connector, comprising:

an elongated housing having a top wall and a bottom wall opposed to the top wall, the top wall having a first mounting surface at a rear end thereof, and the bottom wall having a second mounting surface at a rear end thereof; and a plurality of contacts retained in the housing, the contacts comprising a plurality of first contacts arranged in an upper row and a plurality of second contacts arranged in a lower row parallel to the upper row, each first contact having a first retaining portion retained in the top wall and horizontally extending to the first mounting surface, a first contact portion forwardly extending from a front end of the first retaining portion and a first connecting portion extending from a rear end of the first retaining portion, each second contact having a second retaining portion retained in the bottom wall and horizontally extending to the second mounting surface, a second contact portion forwardly extending from a front end of the second retaining portion and a second connecting portion extending from a rear end of the second retaining portion, the first contact portions and the second contact portions defining a first receiving space therebetween to receive a module, the first connecting portions and the second connecting portion defining a second receiving space therebetween to receive a mother board;

wherein the bottom wall is longer than the top wall along an insertion direction of the module to make the second mounting surface is located at a rear side of the first mounting surface.

12. The card edge connector as claimed in claim 11, wherein the first connecting portion has a first bending portion directly bending upwardly from the rear end of the first retaining portion, a second bending portion downwardly bending from a rear end of the first bending portion and a first mating portion at a free end of the second bending portion to connect with one side of the mother board, and the second connecting portion has a third bending portion upwardly bending from the second retaining portion and a second mating portion at a free end of the third bending portion to connect with another side of the mother board.

13. The card edge connector as claimed in claim 12, wherein the first bending portion, second bending portion and third bending portion are staggered with each other along the insertion direction, while the first mating portion and the second mating portion are aligned to each other along the up to down direction.

14. The card edge connector as claimed in claim 12, wherein the first mating portions are located at an upper side of the first contact portions and the first bending portion, and the second mating portions are located at an upper side of the second contact portions and the third bending portion, and the first bending portion is located at a front side of the second mounting surface along the insertion direction.

15. The card edge connector as claimed in claim 12, wherein the housing defines a cutout between the first mounting surface and the second mounting surface along the insertion direction to receive the first bending portion, the cutout communicates with the second receiving space and located at a front side of the second receiving space to protect the first bending portion from being resisted by the mother board.

16. The card edge connector as claimed in claim 11, wherein the top wall has a first front section and a first rear section downwardly and backwardly extending from a rear end of the first front section, and the bottom wall has a second front section and a second rear section upwardly and backwardly extending from a rear end of the second front section, the first retaining portions are retained in the first rear section, and the second retaining portions are retained in the second rear section and longer than the first retaining portions.

17. A card edge connector assembly comprising:

an insulative housing extending in a longitudinal direction with a center slot, in a front face, extending along said longitudinal direction for therein receiving a module which is adapted to be inserted into the center slot in a front-to-back direction perpendicular to said longitudinal direction, said center slot dividing the housing into two opposite longitudinal side walls;

two rows of contacts disposed in the housing and located by two sides of the center slot, respectively, each of said contacts defining a front contact portion, and middle retaining section and a rear surface mounting connecting portion under condition that the connecting portions of the contacts of said two rows are arranged for commonly straddling upon two opposite surfaces of a printed circuit board which is adapted to be mounted to a rear face of the housing; wherein the gap defined between the connecting portions of the contacts of two rows is offset from the center slot in a transverse direction perpendicular to both said front-to-back direction and said longitudinal direction to be closer to one of said longitudinal side walls than the other under condition that one row of the contacts disclosed in said one of the longitudinal side walls define the corresponding middle retaining sections at a position in front of the corresponding middle retaining sections of the contacts of the other row.

18. The card edge connector as claimed in claim 17, wherein the connecting portions of the contacts of said row are longer than the connecting portions of the contacts of the other row.

19. The card edge connector as claimed in claim 17, wherein the housing defines two rows of passageways by two sides of the center slot to receive the corresponding two rows of contacts under condition that the passageways of the row receiving the corresponding contacts in said row are shorter than the passageways of the other row receiving the corresponding contacts in said other row.

20. The card edge connector as claimed in claim 17, wherein the middle retaining sections of the contacts of said row are shorter than the middle retaining sections of the contacts of said other row.

* * * * *